US008188822B2

(12) United States Patent
Wang et al.

(10) Patent No.: US 8,188,822 B2
(45) Date of Patent: May 29, 2012

(54) COOLING SYSTEM FOR LARGE POWER TRANSFORMERS

(75) Inventors: Kuen-Cheng Wang, Taichung (TW); Tsair-Rong Chen, Hemei Township, Changhua County (TW); Jeen-Sheen Row, Changhua (TW)

(73) Assignees: Kuen-Cheng Wang, Taichung (TW); The Department of Electrical Engineering, National Chang-Hua University of Education University of Taiwan, Changhua, Changhua County (TW)

( * ) Notice: Subject to any disclaimer, the term of this patent is extended or adjusted under 35 U.S.C. 154(b) by 386 days.

(21) Appl. No.: 12/498,432

(22) Filed: Jul. 7, 2009

(65) Prior Publication Data

US 2010/0012297 A1 Jan. 21, 2010

(30) Foreign Application Priority Data

Jul. 18, 2008 (TW) ..... 97212882 U

(51) Int. Cl.
*H01F 27/10* (2006.01)
*H01F 27/08* (2006.01)

(52) U.S. Cl. ..... 336/57; 336/55; 336/58; 336/61

(58) Field of Classification Search ..... 336/55, 336/57, 58, 61
See application file for complete search history.

(56) References Cited

U.S. PATENT DOCUMENTS 1,539,837 A * 6/1925 Hayes ..... 336/58
1,591,934 A * 7/1926 Davenport ..... 165/104.33
1,802,754 A * 4/1931 Clarke ..... 165/104.31
1,980,821 A * 11/1934 Palueff ..... 174/16.1
2,023,100 A * 12/1935 Rose ..... 315/117
2,479,373 A * 8/1949 Knotts et al. ..... 336/57
2,748,356 A * 5/1956 Kaehni ..... 336/58
2,917,701 A * 12/1959 Salton ..... 361/37
2,947,798 A * 8/1960 Camilli et al. ..... 174/15.1
2,990,528 A * 6/1961 Zimsky et al. ..... 336/58
3,016,230 A * 1/1962 Cederstrom et al. ..... 165/148
3,137,829 A * 6/1964 Dillow et al. ..... 336/57
3,249,817 A * 5/1966 Sinclair et al. ..... 361/699
3,305,813 A * 2/1967 Toothman et al. ..... 336/100
3,362,001 A * 1/1968 Wishman et al. ..... 336/60
3,372,738 A * 3/1968 Jan et al. ..... 165/47
3,466,582 A * 9/1969 Sealey et al. ..... 336/60
3,792,338 A * 2/1974 Barthelemy ..... 361/677

* cited by examiner

*Primary Examiner* — Elvin G Enad
*Assistant Examiner* — Joselito Baisa

(57) ABSTRACT

A cooling system includes a housing having a compartment and an oil inlet. A transformer unit is disposed in the compartment and includes a plurality of large power transformers. A heat-dissipating unit is disposed in the compartment and includes a fluid inlet port member, a fluid outlet port member, a heat conductor, and a plurality of heat exchange pipes. The heat conductor is in thermal contact with the heat exchange pipes. The heat exchange pipes are arranged along a first direction. Each of the heat exchange pipes extends along a plane that is not parallel to the first direction. A cooling oil is introduced into the compartment through the oil inlet such that the transformer unit, the heat conductor, and the heat exchange pipes are immersed in the cooling oil.

5 Claims, 6 Drawing Sheets

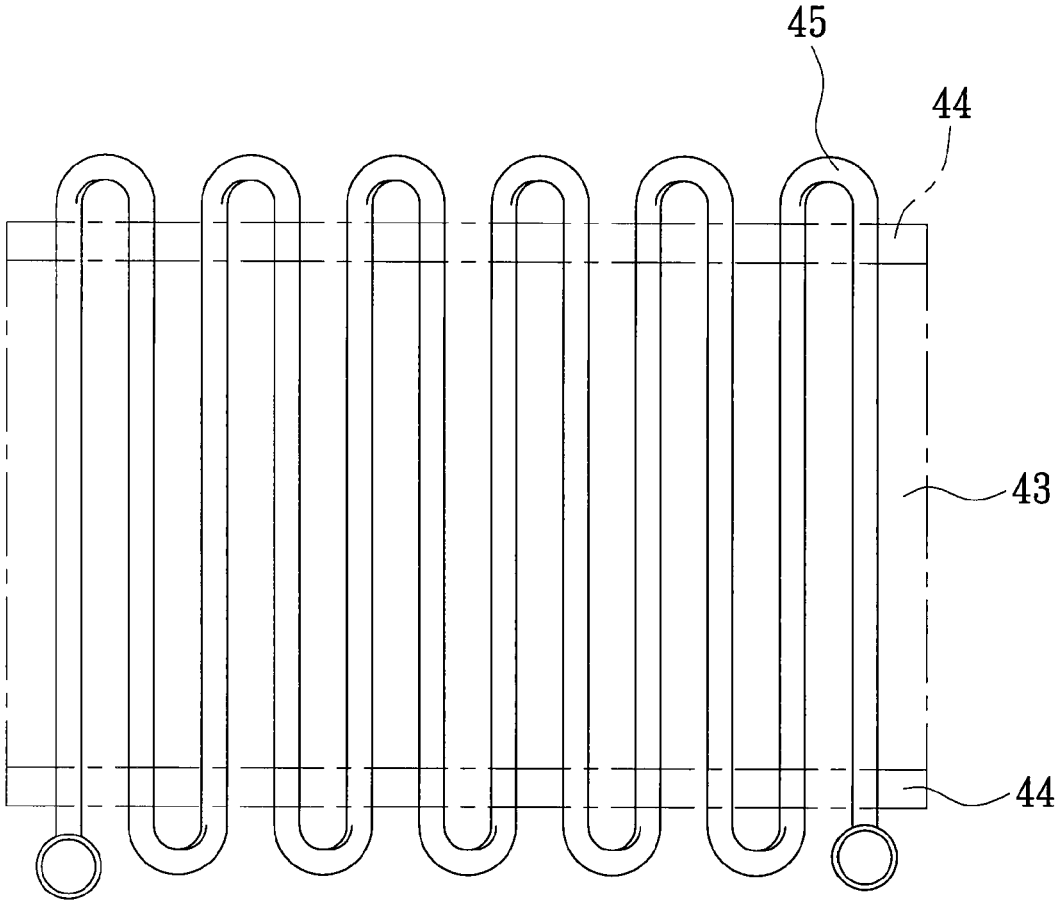
FIG. 5
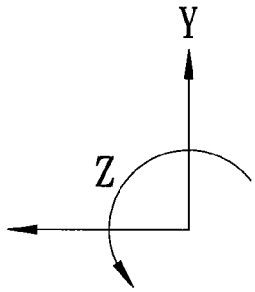

COOLING SYSTEM FOR LARGE POWER TRANSFORMERS

CROSS-REFERENCE TO RELATED APPLICATION

This application claims priority of Taiwanese application no. 097212882, filed on Jul. 18, 2008.

BACKGROUND OF THE INVENTION

1. Field of the Invention

The invention relates to a cooling system, more particularly to a cooling system for large power transformers.

2. Description of the Related Art

It is necessary to dissipate heat from a large power transformer during operation to sustain operating efficiency. As shown in FIG. 1, a housing 10 has a liquid inlet 11 formed at an uppermost portion of the housing 10, a liquid outlet 12 formed at a lowermost portion of the housing 10, and a heat exchange pipe 13 in fluid communication with the liquid inlet 11 and the liquid outlet 12. A transformer (not shown) is disposed in the housing 10. The heat exchange pipe 13 extends along an inner surface of the housing 10 spirally and downwardly. A cooling oil (not shown) is introduced into the housing 11 such that the transformer and the heat exchange pipe 13 are immersed in the cooling oil.

However, a heat-dissipating ability of the cooling system is limited to a heat exchanging area between the heat exchange pipe 13 and the cooling oil, i.e., the larger the heat exchanging area is, the better the heat-dissipating ability of the cooling system will be. Since the heat-dissipating ability is limited by the heat exchanging area between the heat exchange pipe 13 and the cooling oil, when a larger power transformer is employed in the conventional cooling system, heat generated by the larger power transformer cannot be dissipated effectively.

SUMMARY OF THE INVENTION

Therefore, the object of the invention is to provide a cooling system for large power transformers capable of alleviating the above drawback of the prior art.

Accordingly, a cooling system for large power transformers of the present invention comprises a housing having a compartment and an oil inlet that is in fluid communication with the compartment. A transformer unit is disposed in the compartment and includes a plurality of large power transformers. A heat-dissipating unit is disposed in the compartment and includes a fluid inlet port member, a fluid outlet port member, a heat conductor, and a plurality of heat exchange pipes being fluid communication with the fluid inlet port member and the fluid outlet port member. The fluid inlet port member has an inlet disposed outwardly of the housing. The fluid outlet port member has an outlet disposed outwardly of the housing. The heat conductor is in thermal contact with the heat exchange pipes. The heat exchange pipes are arranged along a first direction. Each of the heat exchange pipes extends along a plane that is not parallel to the first direction. A cooling oil is introduced into the compartment of the housing through the oil inlet such that the transformer unit, the heat conductor, and the heat exchange pipes are immersed in the cooling oil.

BRIEF DESCRIPTION OF THE DRAWINGS

Other features and advantages of the invention will become apparent in the following detailed description of the embodiment with reference to the accompanying drawings, of which:

FIG. 5 is a schematic top view of a heat exchange pipe of the preferred embodiment of the present invention.

DETAILED DESCRIPTION OF THE PREFERRED EMBODIMENT

Figure 1:
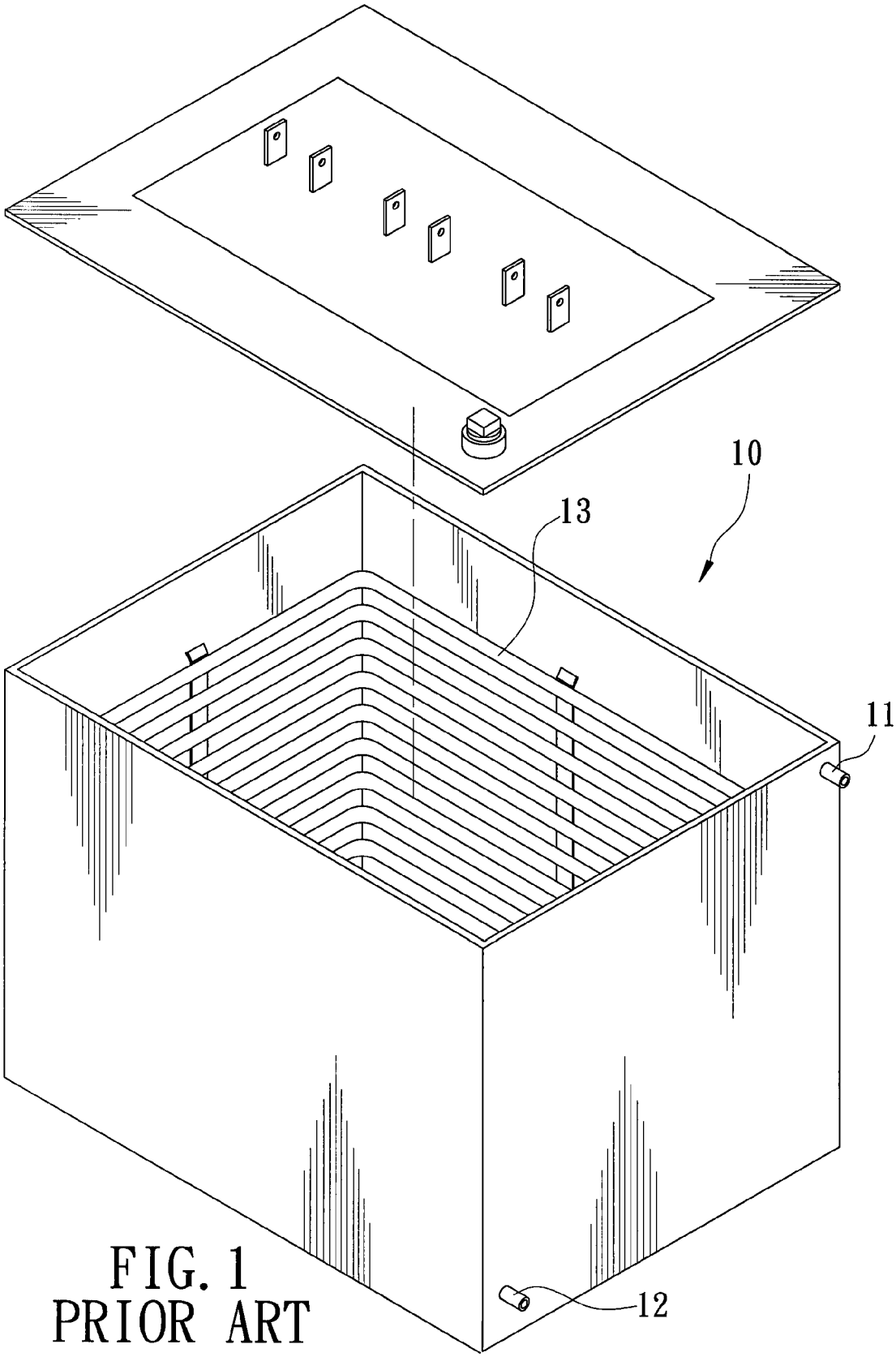
FIG. 1 PRIOR ART
FIG. 1 is a partly exploded perspective view of a conventional cooling system.
Figure 2:
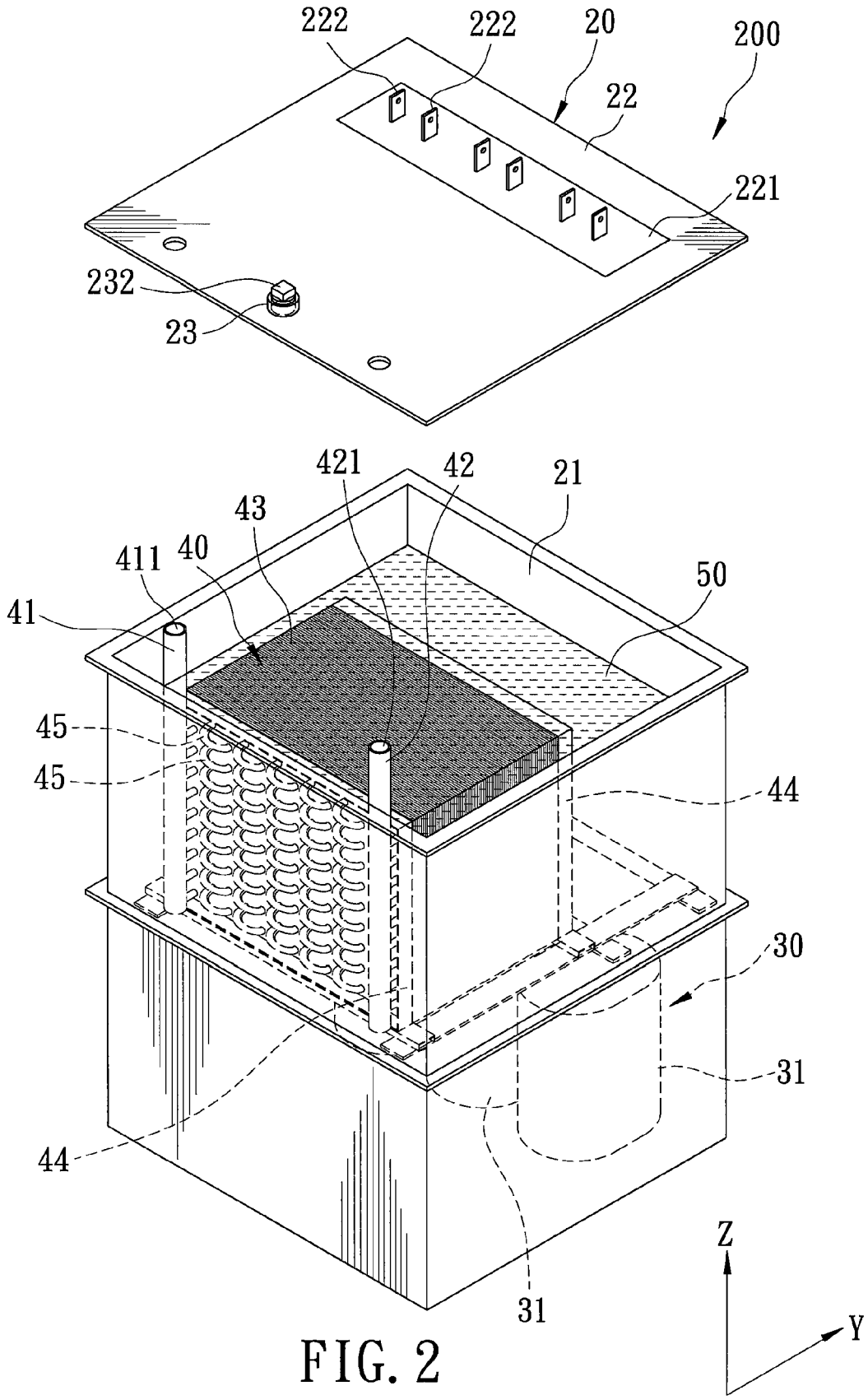
FIG. 2 is a partly exploded perspective view of a cooling system for large power transformers of a preferred embodiment according to the present invention.

Referring to FIGS. 2 to 5, a cooling system 200 for large power transformers of the preferred embodiment according to the present invention includes a housing 20, a transformer unit 30, a heat-dissipating unit 40, and a cooling oil 50.

The housing 20 includes a compartment 21, a housing cover 22, an oil inlet 23, and an oil inlet cover 232. The oil inlet 23 is in fluid communication with the compartment 21 and is formed in the housing cover 22. The compartment 21 has an upper end opening that is covered by the housing cover 22. The housing cover 22 includes an insulating wiring portion 221, and a plurality of pairs of electrode connectors 222 extending through the wiring portion 221.

The transformer unit 30 is disposed in the compartment 21 and includes a plurality of large power transformers 31. The pairs of the electrode connectors 222 are respectively and electrically connected to the transformers 31.

The heat-dissipating unit 40 is disposed in the compartment 21 and above the transformer unit 30, and is misaligned from the transformer unit 30 along the first direction (Z). The heat-dissipating unit 40 includes a fluid inlet port member 41, a fluid outlet port member 42, a heat conductor 43, two clamps 44, and a plurality of heat exchange pipes 45.

The fluid inlet port member 41 has an inlet 411 disposed outwardly of the housing 20. The fluid outlet port member 42 has an outlet 421 disposed outwardly of the housing 20. The fluid inlet port member 41 and the fluid outlet port member 42 of the heat-dissipating unit 40 are configured as metal tubes that extend out of the housing 20 along the first direction (Z). The heat conductor 43 is in thermal contact with the heat exchange pipes 45. The heat exchange pipes 45 have two ends that are connected to and in fluid communication with the fluid inlet port member 41 and the fluid outlet port member 42, respectively.

The heat conductor 43 of the heat-dissipating unit 40 is in thermal contact with and is disposed around the heat exchange pipes 45, and includes a plurality of spaced-apart heat-dissipating fins 431.

The clamps 44 are fixed in the housing 20 for clamping the heat conductor 43 therebetween. The heat exchange pipes 45 extend through the clamps 44 and the heat conductor 43.

Each of the heat exchange pipes 45 is configured to extend along a snake-like route. The number of the heat exchange pipes 45 is nine in this embodiment (see FIG. 3). The heat exchange pipes 45 are arranged along the first direction (Z), and extend along a plane that is not parallel to the first direction (Z). Each of the heat exchange pipes 45 has a set of straight pipe portions extending along a second direction (Y) perpendicular to the first direction (Z).

Figure 3:
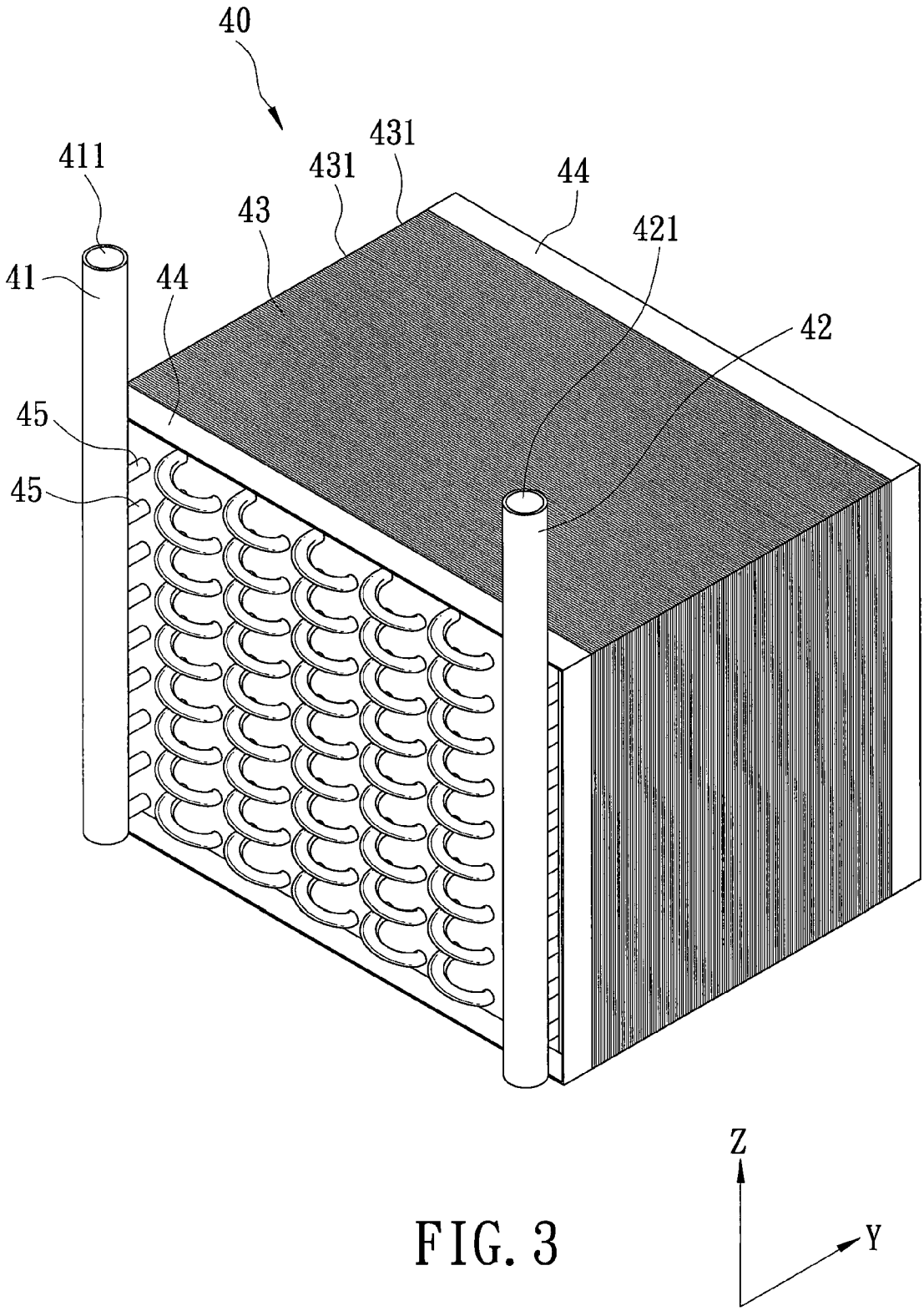
FIG. 3 is a perspective view of a heat-dissipating unit of the preferred embodiment of the invention.
Figure 4:
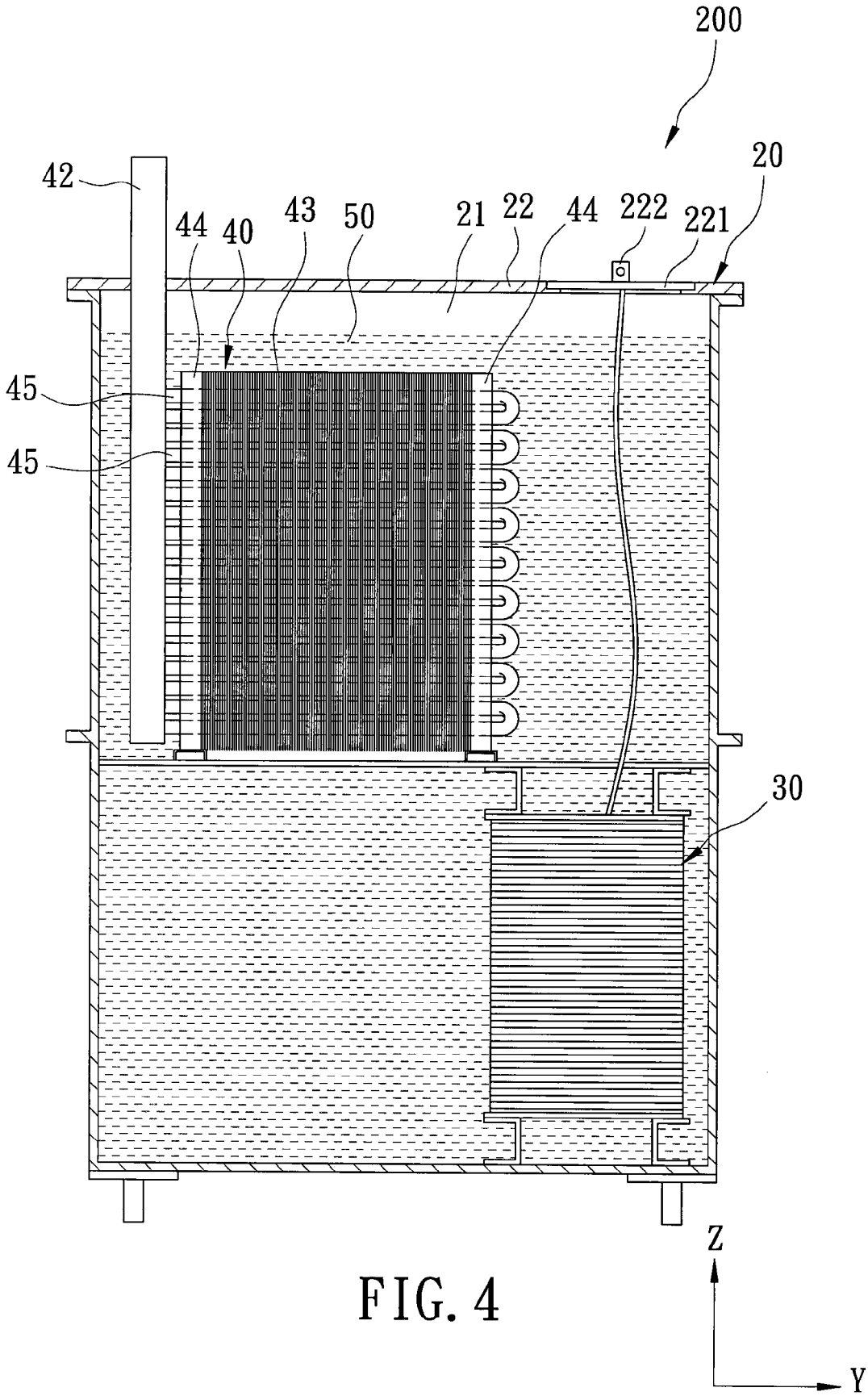
FIG. 4 is a schematic sectional view of the preferred embodiment of the present invention.
Figure 6:
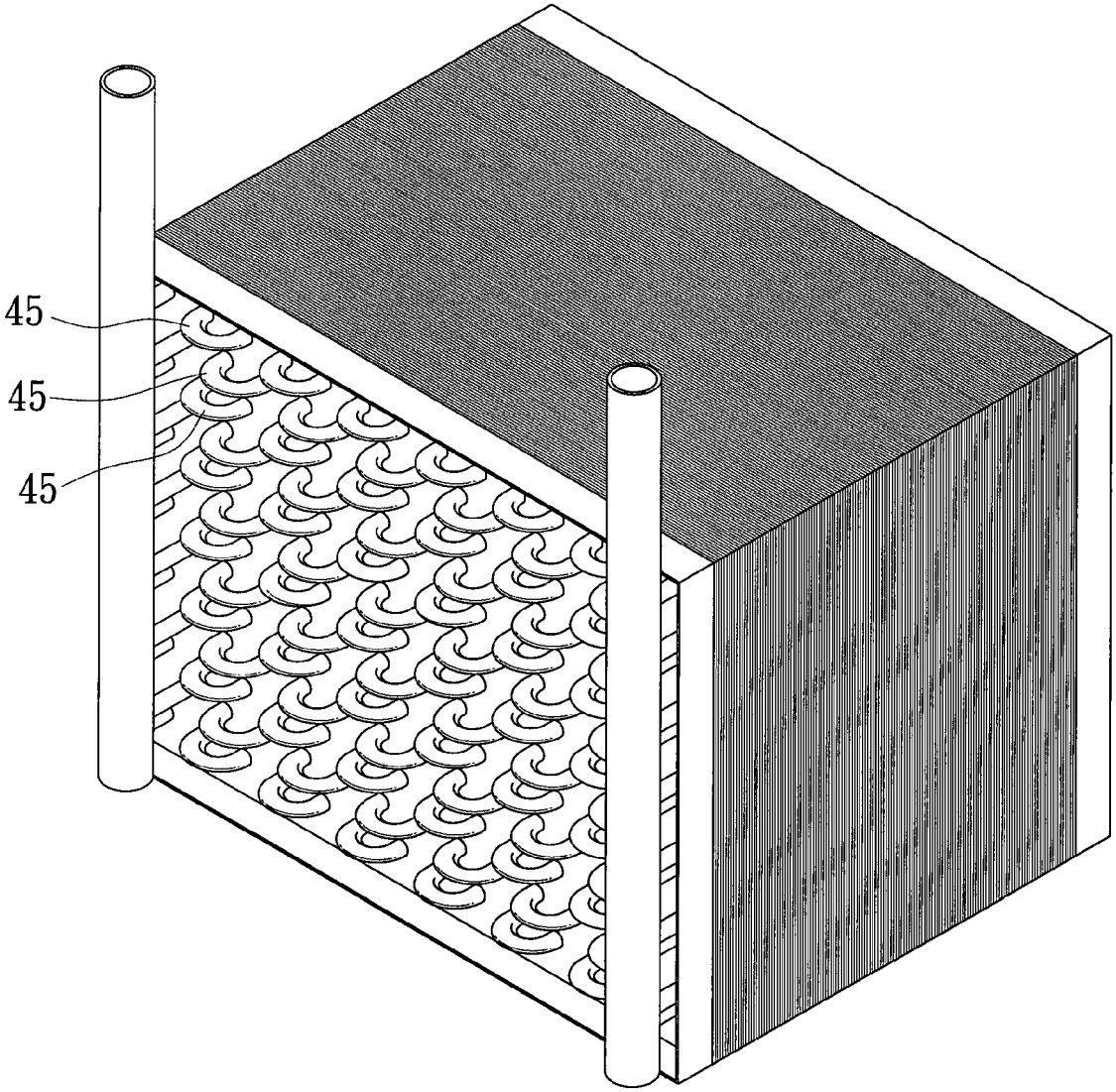
FIG. 6 is a perspective view showing a modified heat-dissipating unit.

Referring to FIG. 6, there is shown a modified heat-dissipating unit 40 which differs from that shown in FIG. 3 in that the straight pipe portions of each of the heat exchange pipes 45 are misaligned respectively from those of an adjacent one of the heat exchange pipes 45 along the first direction (Z). The number of the heat exchange pipes 45 is thirteen in FIG. 6. The heat-dissipating ability of the modified heat-dissipating unit 40 is better than that of the heat-dissipating unit 40 shown in FIG. 3 due to an increase in the heat exchanging area.

The cooling oil 50 is introduced into the compartment 21 of the housing 20 through the oil inlet 23 such that the transformer unit 30, the heat conductor 40, and the heat exchange pipes 45 are immersed into the cooling oil 50.

To sum up, a heat exchanging area between the cooling oil 50 and the heat exchange pipes 45 is greater than that of the prior art such that, the heat dissipating ability of the cooling system 200 is substantially improved.

While the invention has been described in connection with what is considered the most practical and embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A cooling system for large power transformers, comprising:

a housing having a compartment and an oil inlet being in fluid communication with said compartment;

a transformer unit disposed in said compartment and including a plurality of large power transformers;

a heat-dissipating unit disposed in said compartment and including a fluid inlet port member, a fluid outlet port member, a heat conductor, and a plurality of heat exchange pipes being fluid communication with said fluid inlet port member and said fluid outlet port member, said fluid inlet port member having an inlet disposed outwardly of said housing, said fluid outlet port member having an outlet disposed outwardly of said housing, said fluid inlet port member and said fluid outlet port member of said heat-dissipating unit configured as metal tubes that extend out of said housing along a first direction, said heat conductor being thermal contact with said heat exchange pipes, said heat exchange pipes being arranged along said first direction, each of said heat exchange pipes extending along a plane that is perpendicular to said first direction, said heat-dissipating unit including two clamps, said clamps being fixed in said housing for clamping said heat conductor therebetween, said heat exchange pipes extending through said clamps and said heat conductor, said heat exchange pipes being configured to extend along a snake-like route, each of said heat exchange pipes having a set of straight pipe portions extending along a second direction that is perpendicular to said first direction; and a cooling oil being introduced into said compartment of said housing through said oil inlet such that said transformer unit, said heat conductor, and said heat exchange pipes are immersed in said cooling oil.

2. The cooling system as claimed in claim 1, wherein said compartment of said housing has an upper end opening, said housing including:

a housing cover for covering said upper end opening of said compartment, said oil inlet being formed in said housing cover; and an oil inlet cover for covering openably said oil inlet.

3. The cooling system as claimed in claim 2, wherein said housing cover includes an insulating wiring portion, and a plurality of pairs of electrode connectors extending through said wiring portion, said pairs of said electrode connectors being respectively and electrically connected to said transformers disposed in said compartment.

4. The cooling system as claimed in claim 1, wherein said heat conductor of said heat-dissipating unit is disposed around said heat exchange pipes, and includes a plurality of spaced-apart heat-dissipating fins.

5. The cooling system as claimed in claim 1, wherein said heat-dissipating unit is disposed above said transformer unit and is misaligned from said transformer unit along the first direction.

* * * * *